United States Patent [19]

MacAndrew

[11] Patent Number: 4,903,079

[45] Date of Patent: Feb. 20, 1990

[54] VARIABLE MAGNIFICATION COPIER

[75] Inventor: John A. MacAndrew, Eaton Ford, United Kingdom

[73] Assignee: Xerox Corporation, Stamford, Conn.

[21] Appl. No.: 236,079

[22] Filed: Aug. 24, 1988

[30] Foreign Application Priority Data

Aug. 24, 1987 [GB] United Kingdom ..... 8719950

[51] Int. Cl.[4] ..... G03G 15/28

[52] U.S. Cl. ..... 355/235; 355/243; 355/57

[58] Field of Search ..... 355/55, 56, 8, 11, 57, 355/235, 243; 354/4

[56] References Cited

U.S. PATENT DOCUMENTS

| | | | |
|---|---|---|---|
| 3,126,809 | 3/1964 | Adams et al. | 95/75 |
| 3,861,797 | 1/1975 | Nishida et al. | 355/52 |
| 3,967,898 | 7/1976 | Klann | 355/110 |
| 4,111,551 | 9/1978 | Klann | 355/84 |
| 4,391,506 | 7/1983 | Koide | 355/8 |
| 4,543,643 | 9/1985 | Shibazaki et al. | 364/900 |
| 4,593,999 | 6/1986 | Adaichi et al. | 355/55 |
| 4,614,423 | 9/1986 | Yoshiura | 355/55 |
| 4,657,380 | 4/1987 | Hamano et al. | 355/55 |

FOREIGN PATENT DOCUMENTS

| | | |
|---|---|---|
| 097776 | 1/1984 | European Pat. Off. . |
| 60-76769 | 5/1985 | Japan . |
| 60-151662 | 8/1985 | Japan . |
| 2176620 | 12/1986 | United Kingdom . |

*Primary Examiner*—L. T. Hix
*Assistant Examiner*—D. Rutledge

[57] ABSTRACT

A variable magnification scanning optical system for a copying machine includes a lens (10) for projecting an image of an original document (2) with a pre-selected magnification onto a moving imaging member (6). The scan speed may be varied relative to the speed of the imaging member to alter the magnification in the scan direction. To this end a reference signal is generated which is derived from the imaging member and is indicative of the nominal pre-selected magnification. A second signal is generated indicative of the scan speed and the scan speed is varied, e.g. by a servo system (see FIG. 2), until the second signal matches the reference signal. To compensate for tolerances between the nominal magnification and the actual magnification, the reference signal may be adjusted by applying an offset value (23) stored in the memory. This offset value may be entered into the memory by an operator via a keyboard panel (22). Also, compensation may be made independently for magnification tolerances in the cross-scan direction, again by the application of an offset value stored in a memory, to move the lens from its home position corresponding to nominal unity magnification to a new position corresponding to actual unity magnification.

9 Claims, 1 Drawing Sheet

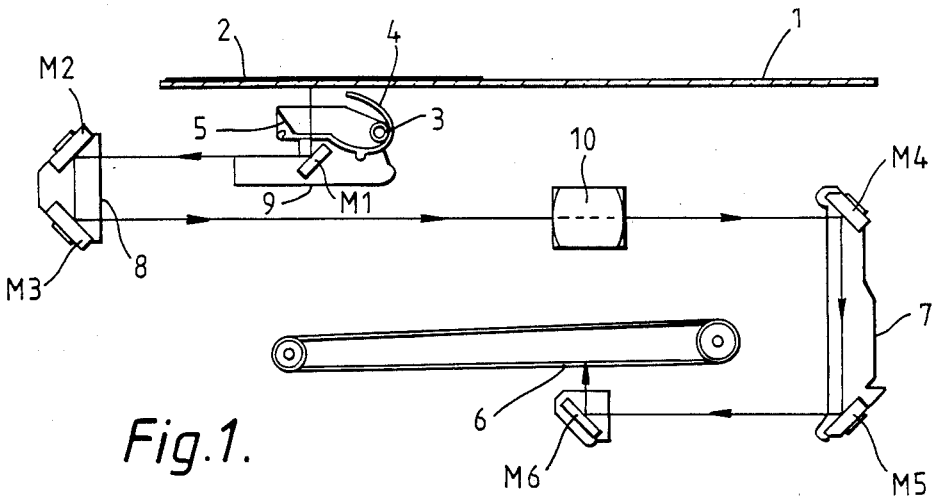
Fig.1.
Fig.2.
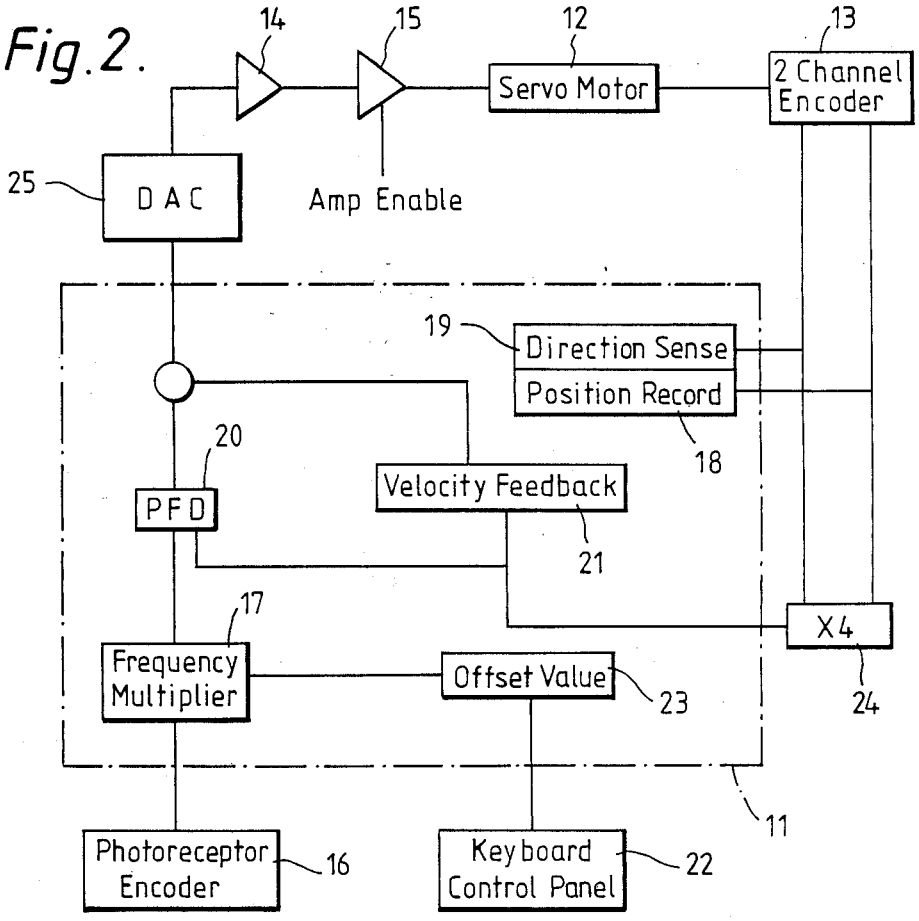

VARIABLE MAGNIFICATION COPIER

BACKGROUND AND INFORMATION DISCLOSURE STATEMENT

This invention relates to a variable magnification optical system for a copying machine comprising a lens for projecting an image of an original document with a pre-selected magnification onto an imaging member. The invention further relates to a copying machine incorporating such an optical system.

In a scanning optical system the imaging member is moved in the direction of scan and the image of the document is projected a strip at a time onto the moving imaging member to reproduce the whole of the document as an image thereon. By varying the scan speed relative to the speed of the imaging member it is possible to alter the size of the image along the length of the belt, i.e. in the scanning direction. In full size copying, that is to say at unity magnification, the scan speed is equal to the speed of the imaging member. Increasing the scan speed makes the image shorter, i.e. reduction; and decreasing the scan speed makes the image longer, i.e. enlargement. To this end, a reference signal may be generated, the value of which is determined by the speed of the imaging member and the nominal pre-selected magnification. A second signal is generated indicative of the scan speed. The two signals are compared and the scan speed is varied until the second signal matches the reference signal. In practice, however, the actual magnification achieved may differ from the nominal magnification due to mechanical tolerances in the system.

The image size can also be varied in the direction transverse to the scan direction by moving the lens along its optical axis. The lens has a home position corresponding to nominal unity magnification, but again, due to tolerances in the system, this home position for the lens may yield an actual magnification which is at variance with the nominal magnification.

The concept of reducing or enlarging an image via a velocity mismatch of scanner image to a moving medium is known in the photographic and copy art. U.S. Pat. Nos. 3,126,809; 4,111,551 and 3,967,898 associated with the photographic art, disclose the production of copies from a negative, elongating or compressing the copy in a single direction. In U.S. Pat. No. 4,111,551 a negative and a photosensitive film are separately transported at different linear speed-past an elongated pair of drive rollers. The extent of image compression or elongation can be varied continually by means of a differential speed drive mechanism interconnecting the drive roller. In U.S. Pat. No. 3,126,809 a negative and print paper are moved relative to each other while the negative is being illuminated through a moving mode with a light slit. In U.S. Pat. No. 3,967,898 a predetermined amount of distortion in one direction is produced by varying the relative motions of a film image sheet and a superimposed photosensitive material sheet across a light slit.

A scanning system is also disclosed in U.S. Pat. No. 3,861,797 in which an original is reproduced in one direction at the original size and then elongated or compressed in a second direction. An original document is placed on a movable platen and illuminated from above by a light source so as to cause an image to be projected by a lens beneath the platen through a pair of slits and a sensitive film disposed in an image plane. The relative speed of the plate and the film are varied to obtain the desired unidirectional magnification.

U.S. Pat. No. 4,543,643 discloses a system for setting the magnification in a copying machine, which comprises means for manually inputting a numerical value, a memory means having a plurality of memory locations, selection key means for selecting one from the plurality of memory locations, and control means for storing a numerical value input by the numerical value input means in said one of the memory locations selected by the selection key means, so that the copying apparatus operates to set copying magnification by a numerical value stored in said one of the memory locations.

Japanese Patent No. 60-151662 discloses a memory means in a copying machine using values stored in a ROM and RAM memory locations as numerical copying magnification data. This data can be automatically selected and displayed when the operator demands magnification display.

Japanese Patent No. 58-54358 teaches a copying machine including means to change the magnification of an original to selected magnifications on the basis of size relation, in one direction or the other, between the original and copy.

U.S. Pat. No. 4,629,314 discloses a copying machine provided with a variable magnification operation memory function.

Japanese Patent 60-76769 discloses a means for selecting and setting a magnification using stored numerical data in a RAM which is backed up by the battery of a microcomputer.

According to the present invention, there is provided a variable magnification optical system for a copying machine, comprising a lens for projecting an image of an original document with a pre-selected magnification onto an imaging member, wherein at least one parameter may be altered to achieve the pre-selected magnification, means for generating a reference signal indicative of the nominal pre-selected magnification, means for generating a second signal indicative of the prevailing value of said parameter, and means for comparing the second signal with said reference signal and for automatically altering said parameter until the second signal matches said reference signal, and means for adjusting the value of the reference signal subtantially to compensate for tolerances between the nominal magnification and the actual magnification.

The system in accordance with the invention has the advantage that compensation can be made for tolerances between the nominal magnification and the actual magnification so that when the operator selects a particular magnification the copier optical system may easily be adjusted (either by the operator himself or a service engineer) to ensure that the copy magnification closely matches the chosen value.

On the other hand, the system may be adjusted purposely to yield an actual magnification which deviates from the nominal magnification by a desired amount in order to cater to particular customer requirements. For example, the system may be adjusted to achieve an actual magnification which is less than, say 99% of, the nominal magnification to ensure that none of the image is lost for edge to edge originals throughout the magnification range. Alternatively, the actual magnification may be increased to, say, 101% of the nominal magnification to ensure that the copies are free of black borders.

Suitably, the adjustment is made by means of an offset value which is stored in a memory and applied to modify the reference signal at all magnifications. Preferably, this offset value is entered into the memory via an operator accessible control panel, specifically a keyboard. The offset value may be determined simply by entering an integer which may be multiplied by a constant factor also stored in a memory before it is finally stored (and applied) as the offset value.

In a scanning optical system, the above magnification correction applies in the scan direction only. However, in the cross-scan direction, the position of the lens may be altered from its home position corresponding to nominal unity magnification to a new position corresponding to actual unity magnification in order to compensate for magnification tolerances in this direction also. Again, this correction may be made by the application of an offset value which may be entered and stored in a memory in a similar manner as for the scan-direction correction and applied at all magnifications.

An optical system in accordance with the invention thus has the advantage that it enables independent adjustment of the nominal magnification in two orthogonal directions.

An embodiment of the invention will now be described, by way of example, with reference to the accompanying drawing in which:

FIG. 1 is a schematic representation of a variable magnification scanning optical system for a xerographic copier in accordance with the invention, and FIG. 2 is a diagram illustrating the control for the scanning optical system in FIG. 1.

DESCRIPTION OF THE INVENTION

FIG. 1 shows, in schematic form, the prime components of the optical system of a xerographic copier, or other reproducing machine, within which the present invention may be employed. The optical system includes a stationary glass platen 1 on which an original document 2 to be reproduced is located for copying. The original document is illuminated in known manner a narrow strip at a time by a light source comprising a tungsten halogen lamp 3. Light from the lamp is concentrated by an elliptical reflector 4 and directed to the platen and to an inclined mirror 5. The two light components combine to form a narrow strip of light at the side of the original document 2 facing the platen 1. The original document 2 thus exposed is imaged onto a photoreceptor 6 via system of mirrors M1 to M6 and the focusing lens 10. The photoreceptor may, for example, be in the form of an endless flexible belt. In order to copy the whole original document, the lamp 3, the reflector 4, and mirror 5 are mounted on full rate carriage 9 which travels laterally at a given speed directly below the platen and thereby scans the whole document. Because of the folded optical path, the mirrors M2 and M3 are mounted on another carriage 8 which travels laterally at half the speed of the full rate carriage in order to maintain the optical path constant. The photoreceptor 6 is also in motion whereby the image is laid down strip by strip to reproduce the whole of the original document scan image on the photoreceptor. By varying the speed of the scan carriages relative to the photoreceptor belt 6, it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriages makes the image shorter, i.e. reduces the image; and decreasing the speed of the scan carriages makes the image longer, i.e, enlarges the image.

In practice, the photoreceptor speed may fluctuate and it is necessary, therefore, to ensure that the scan carriages closely track these fluctuations to ensure that copies are made with accurate magnification and without image smear.

In order to match the speed of the scan carriages to that of the photoreceptor, their respective speeds are locked together via the constant of inverse proportionality, magnification. Suitably, the photoreceptor speed is chosen as master and the speed of the scan carriages is adjusted accordingly.

As described in more detail below, a closed loop servo system is employed to manage the scanning system controlled by a microprocessor 11 (FIG. 2), such as an Intel 8052 TM. The source of power of prime mover for the optic system is a servo motor 12. The system controlling the motor 12 comprises a digital to analogue converter 25, a compensation network 14, and a power amplifier 15.

A two-channel quadrature encoder 13 is mounted on the optics motor 12 to produce pulses which are monitored by the microprocessor 11. The position of the scan carriages is monitored within the microprocessor 11 at 18 by counting the number of pulses and the direction of movement is determined at 19 within the microprocessor from the relative phases of the pulses on the two channels. The speed of the scan carriages is calculated within the microprocessor from the frequency of the pulses. Thus, the pulse signal from the encoder 13 is indicative of the speed of the motor 12.

A master signal is also supplied to the microprocessor 11 from an encoder 16 on the photoreceptor. The frequency of this signal from the photoreceptor encoder is indicative of the speed of the photoreceptor.

The speed of the motor 12 is adjusted to follow the speed of the photoreceptor by equating their respective frequencies via the constant of proportionality. That is to say, if the carriage speed is slower than the photoreceptor speed divided by the magnification then the command voltage of the motor amplifier 15 is increased thereby increasing the speed of the carriages and visa versa.

In a particular example, the photoreceptor encoder 16 has a nominal frequency of 400 Hz when the speed of the photoreceptor is approximately 172 millimeters/sec, and the motor encoder 13 has a frequency on either channel of approximately 156.5 Hz when the carriages are travelling at 172 mm/sec. The signal from the encoder 13 is multiplied by a factor 4 to 626 Hz by circuitry 24 before comparison. The technique used to compare the speeds of the carriage and the photoreceptor is to maintain the speed of optics motor 12 such that the frequency signals derived from the two encoders are matched. To achieve this the factored motor encoder frequency is not locked directly to the reference encoder frequency, but to a signal derived from the photoreceptor encoder 16 which is equal in frequency to that provided by the motor encoder 13 when the carriages are travelling at the same speed as the photoreceptor divided by the magnification, that is to say at the desired speed. To this end the frequency signal from the photoreceptor encoder is multiplied by a factor inversely proportional to the magnification by a frequency multiplier algorithm 17 within the microprocessor 11.

There are now two signals available for direct comparison and matching, namely the factored photoreceptor pulse train emanating from frequency multiplier 17 and the external X4 motor encoder pulse train emanating from the circuitry 24. The motor 12 is driven in such manner that the respective frequency signals are locked together whereby the scan carriages track the speed of the photoreceptor in dependence of the magnification selected and taking account of any fluctuations in the speed of the photoreceptor.

The means by which the frequency locking is effected will now be described. The fundamental principle is to increase the command to the motor 12 if it is running too slowly, and to reduce the command if it is running too fast. This is achieved by a phase-frequency detector algorithm (PFD) 20 which acts in such manner that the value on the port of the digital to analogue converter 25 is changed in a sense appropriate to correct for any deviation between the two frequency inputs. Regardless of the initial speed of the motor, it will always tend to the speed at which the frequencies of the two pulse trains are equal.

In addition to the speed lock loop described above, a velocity feed back loop 21 is also included wherein the speed of the motor is fed back to the command system without reference to an external master encoder. The system is organized so that the motor resists changes to its speed, whereby the servo is stabilized. This is achieved by reducing the command to the motor if the motor speed increases and vice versa.

Two command signals from the speed lock loop (PFD algorithm) and the velocity feed back loop respectively are added before they are applied to the amplifier 15. This is achieved simply by superimposing the signals on the port of the digital to analogue converter 25.

As mentioned previously, the photoreceptor encoder generates a pulse signal at 400 Hz when the photoreceptor is moving at 172 mm/sec. To compensate for tolerances between the nominal magnification and the actual magnification of the optical system the reference frequency may be altered by an operator or service engineer when the copier is in an appropriate diagnostic mode. In this way, an offset value may be applied to the original frequency by entering, e.g. via the keyboard panel 22, an integer between, say, ±99. The offset value is suitably stored in a non-volatile memory (NVM) location 23 within the microprocessor 11. Normally the value stored in this NVM location is zero. A positive entry will enlarge the image and a negative will shrink the image. By way of example, the magnification may be changed by 0.015% equivalent to 0.032 mm across an A4 page for a change of 1 in the magnification offset value.

The offset value effects a permanent correction to the frequency from the frequency multiplier 17 by altering the multiplication factor thereof to correct for magnification tolerance errors across the entire spectrum of magnification. Thus, for example, if at nominal unity magnification the image is found to have an actual magnification 1.03, an offset value of −2 may be entered at the keyboard which will add 0.19Hz to the frequency generated by the frequency multiplier 17,viz. 626 Hz at 172 mm/sec, to generate a modified reference frequency of 626.19 Hz (at 172 mm/sec) which is applied to the PFD 20. The frequency of the motor encoder 13 will be adjusted automatically to match the modified reference voltage and hence the speed of the scan carriage will be reduced thereby shrinking the image to achieve actual unity magnification.

The image size can also be varied in the direction orthogonal to the scan direction by moving the lens 10 along its optical axis closer to the original document, i.e. closer to mirrors M2 and M3, for magnification greater than unity, and away from mirrors M2 and M3 for reduction, i.e. magnification less than unity, using a stepper motor. When the lens 10 is moved, the length of the optical path between the lens and the photoreceptor, i.e. the image distance, is also varied by moving mirrors M4 and M5 in unison to ensure that the image is properly focused on the photoreceptor 6.

When the lens is moved to a home position the nominal magnification in the cross-scan direction is unity. In, practice, however, there may also be a tolerance in this direction between the nominal magnification and the actual magnification. To compensate for this, the operator or service engineer may again enter an offset value at the keyboard panel which is stored in a non-volatile memory location within the microprocessor and is applied as a permanent correction factor to the stepper motor which controls the lens position. Generally, a larger number will cause the image to shrink, whereas a smaller number will enlarge it in the cross-scan direction. For example, a change of one will alter the position of the lens by one step and thereby cause a change in magnification by 0.11% equivalent to 0.3 mm along the length of an A4 page.

In view of the foregoing description, it will be evident to a person skilled in the art that various modifications may be made within the scope of the following claims.

What is claimed is:

1. A variable magnification optical system for a copying machine comprising a lens for projecting an image of an original document with a pre-selected magnification onto an imaging member, wherein at least one parameter may be altered to achieve the pre-selected magnification, means for generating a reference signal indicative of the nominal pre-selected magnification, means for generating a second signal indicative of the prevailing value of said parameter, means for comparing the second signal with said reference signal and for automatically altering said parameter until the second signal matches said reference signal and means for adjusting the value of the reference signal substantially to compensate for tolerances between the nominal magnification and the actual magnification, said adjusting means, comprising means for adjusting the value of the reference, comprises signal memory means for storing an offset value which is applied to modify the reference signal at all magnifications.

2. A variable magnification optical system as claimed in claim 1, including means for optically scanning the original document wherein the imaging member is moved in the scanning direction so that the image of the document may be projected a strip at a time onto the moving imaging member to reproduce the whole of the document as an image on the imaging member, wherein the parameter which may be altered to achieve the pre-selected magnification is the scan speed relative to the speed of the imaging member.

3. A variable magnification optical system as claimed in claim 2, comprising means for moving the lens along its optical axis whereby the magnification may be varied in the direction transverse to the scan direction, the lens having a home position associated with nominal unity magnification in said transverse direction, and further comprising means for adjusting the home position of the lens substantially to compensate for tolerances between the nominal magnification and the actual magnification in said transverse direction.

4. A variable magnification optical system as claimed in claim 3, wherein the means for adjusting the home position of the lens comprises memory means for storing an offset value which is applied to the means for moving the lens to modify the lens position at all magnifications.

5. A variable magnification optical system as claimed in claim 3, wherein the means for moving the lens comprises a stepper motor.

6. A variable magnification optical system as claimed in claim 1, wherein the offset value is entered into the memory means via an operator-accessible control panel.

7. A variable magnification optical system as claimed in claim 6, wherein the offset value is determined by entering an integer at the control panel.

8. A variable magnification optical system as claimed in claim 7, comprising memory means for storing a factor by which the integer is multiplied before it is stored as the offset value.

9. A variable magnification optical system as claimed in claim 6, wherein the memory means are non-volatile.

* * * * *